United States Patent [19]

Mizoguchi

[11] 4,396,293

[45] Aug. 2, 1983

[54] SALAT TIME ALARM ELECTRONIC TIMEPIECE

[75] Inventor: Takatoshi Mizoguchi, Tenri, Japan

[73] Assignee: Sharp Kabushiki Kaisha, Osaka, Japan

[21] Appl. No.: 313,501

[22] Filed: Oct. 21, 1981

[30] Foreign Application Priority Data

| | | | |
|---|---|---|---|
| Oct. 28, 1980 | [JP] | Japan | 55-152865 |
| Oct. 30, 1980 | [JP] | Japan | 55-153354 |
| Oct. 30, 1980 | [JP] | Japan | 55-153355 |
| Oct. 30, 1980 | [JP] | Japan | 55-153356 |
| Nov. 14, 1980 | [JP] | Japan | 55-161064 |
| Nov. 14, 1980 | [JP] | Japan | 55-161065 |

[51] Int. Cl.[3] ..... G04B 19/26; G04B 49/04

[52] U.S. Cl. ..... 368/15; 368/17; 368/18; 368/21

[58] Field of Search ..... 368/15, 17, 18, 21, 368/28, 29, 72, 73, 250, 251, 261

[56] References Cited

U.S. PATENT DOCUMENTS

| | | | |
|---|---|---|---|
| 2,451,639 | 10/1948 | Tellier | 368/18 |
| 2,496,826 | 2/1950 | Tellier | 368/21 |
| 3,940,859 | 3/1976 | Troseth | 368/15 X |
| 4,253,169 | 2/1981 | Salah | 368/15 |

*Primary Examiner*—J. V. Truhe
*Assistant Examiner*—Terrance Flower
*Attorney, Agent, or Firm*—Birch, Stewart, Kolasch & Birch

[57] ABSTRACT

A salat time alarm electronic timepiece is implemented with a one chip microcomputer. An outer read only memory is installed in the electronic timepiece for storing the sunrise time data and the sunset time data at various cities in world. The system reads out sunrise time and sunset time data from the outer read only memory and calculates five salat times of the present day. The thus calculated salat time data is stored in a storage means and compared with the current time data to provide an alarm sound when the current time reaches one of the five salat times.

10 Claims, 20 Drawing Figures

RAM

| | (X) | (Y) | (Z) | (M) | (T) | (U) |
|---|---|---|---|---|---|---|
| 0 | | (1 Sec) | (1YER) | SS m | | (CALW) |
| 1 | | (10 Sec) | (10 YER) | (W) | | |
| 2 | (DSP) | (TIME) (1 MIN) | (CAL) (1 DAT) | | (T) | (1 MIN) |
| 3 | | (10 MIN) | (10 DAT) | (CT) | CALENDAR CORRECTION | (ALM) (10 MIN) |
| 4 | | (1 Hor) | (1 MON) | | | (1 Hor) |
| 5 | | (10 Hor) | (10 MON) | (W′) | | (10 Hor) |
| 6 | | (1 MIN) | | | | |
| 7 | (A L U) | ($S_1$) (10 MIN) | ($S_2$) | ($S_3$) | ($S_4$) | ($S_5$) |
| 8 | | (1 Hor) | (SUNRISE) | | (SUNSET) | |
| 9 | | (10 Hor) | | | | |
| A | (DISPLAY TIMER) | CORRECTION MODE CONTROL FLAG | (ALC) | SALAT CHECK | SUMMER TIME FLAG / 12 24H | |
| B | | (#, #CAL) | DISPLAY MODE | KEY JUDGE | SALAT MODE FLAG | |
| C | (SA) | (C) | (SC) | "F" | | |

FIG.6

| (2CT) | | (1 CT) | | | | (2 W) | | | (1 W) | | | ss | m | | | | | | | |
|---|---|---|---|---|---|---|---|---|---|---|---|---|---|---|---|---|---|---|---|---|
| $A_{13}$ | $A_{12}$ | $A_{11}$ | $A_{10}$ | $A_9$ | $A_8$ | $A_7$ | $A_6$ | $A_5$ | $A_4$ | $A_3$ | $A_2$ | $A_1$ | $A_0$ | $D_7$ | $D_6$ | $D_5$ | $D_4$ | $D_3$ | $D_2$ | $D_1$ | $D_0$ |
| 0 | 0 | 0 | 0 | 0 | 0 | 0 | 0 | 0 | 0 | 0 | 0 | 0 | 0 | ($10^0$ HS) | | | | ($1^1$ HS) | | | |
| 0 | 0 | 0 | 0 | 0 | 0 | 0 | 0 | 0 | 0 | 0 | 0 | 0 | 1 | ($10^1$ MS) | | | | ($1^1$ MS) | | | |
| 0 | 0 | 0 | 0 | 0 | 0 | 0 | 0 | 0 | 0 | 0 | 0 | 1 | 0 | ($10^2$ HR) | | | | ($1^1$ HR) | | | |
| 0 | 0 | 0 | 0 | 0 | 0 | 0 | 0 | 0 | 0 | 0 | 0 | 1 | 1 | ($10^3$ MR) | | | | ($1^1$ MR) | | | |
| --- | --- | --- | --- | --- | --- | --- | --- | --- | --- | --- | --- | --- | --- | --- | | | | --- | | | |

SALAT TIME ALARM ELECTRONIC TIMEPIECE

BACKGROUND AND SUMMARY OF THE INVENTION

The present invention relates to an electronic timepiece for Islamites and, more particularly, to an electronic timepiece which calculates the five salat times.

The Islamite prayer is normally conducted five times a day at a predetermined time. The salat time changes depending on the location on the earth and the date of a year. This is because the salat time is determined depending on the sunrise time and the sunset time. Thus, it is required to provide an electronic timepiece which automatically calculates the salat time in accordance with the introduced information relating to the location on the earth.

An electronic timepiece has been proposed, in U.S. Pat. No. 4,253,169, "Electronic Calculation Watch with Digital Display" by Ibrahim M. Salah issued on Feb. 24, 1981, wherein the operator introduces the data information and the latitude and longitude situation information for obtaining the prayer time. The system calculates the sunrise and sunset time through the use of the introduced situation information and the date information. Since the system is constructed to calculate the sunrise and sunset time through the use of the latitude data and the longitude data, the system becomes inevitably complicated. Thus, the electronic timepiece of a compact size can not be produced.

Accordingly, an object of the present invention is to provide an electronic timepiece of a compact size which automatically calculates the prayer time for the Islamites.

Another object of the present invention is to provide an electronic timepiece which provides an alarm display at each salat time.

Still another object of the present invention is to provide an electronic timepiece for the Islamites, which ensures simple operation.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a read only memory is installed in an electronic timepiece which stores the salat time information in a plurality of preselected cities during a year. When the operator introduces the city information and the date information into a control system of an electronic timepiece of the present invention, the control system functions to address a predetermined memory section in the read only memory for reading out the memorized salat time information. The thus read out salat time information is utilized to signal each salat time. In a preferred form, the data information is automatically obtained from the calendar counter included in the electronic timepiece. Therefore, the operator is required only to introduce the city information.

An embodiment of an electronic timepiece of the present invention performs the following operations.

(1) Normal timepiece operation wherein the electronic timepiece displays the hour information, minute information and second information;

(2) Auto-calendar operation wherein the electronic timepiece displays the year information, month information, date information and day information;

(3) Salat time alarm operation wherein the electronic timepiece provides an alarm sound and/or an alarm display at each of the five prayer times a day;

(4) Prayer condition display operation wherein the electronic timepiece displays whether it is the prayer time or it is a time waiting for the next prayer, and wherein the electronic timepiece displays the salat number in a day; and (5) City selection and city display operation, wherein the electronic timepiece displays the city code number selected by the operator, the city code number being assigned to each of a plurality of preselected cities in the world.

The five salat times are determined in the following way in accordance with the sunrise time and the sunset time.

FIRST SALAT (FAJR)=(sunrise time)−*A*.

where: one hour $\leqq A \leqq$ two hours.

SECOND SALAT (ZUHR)=[(sunrise time)+(sunset time)]/2.

THIRD SALAT (ASR)=[(second salat time)+(sunset time)]/2.

or

THIRD SALAT (ASR)=(second salat time)+*B*.

where: B=three hours.

FOURTH SALAT (MAGRIB)=sunset time.

FIFTH SALAT (ISHA)=(sunset time)+*C*.

where: C=one hour and thirty minutes.

In an embodiment of the present invention, the constant A for determining the first salat (Fajr) time is selected at one (1) hour. The third salat (Asr) time is obtained by the calculation, (second salat time)+(three hours (3)).

BRIEF DESCRIPTION OF THE DRAWINGS

The present invention will be better understood from the detailed description given hereinbelow and the accompanying drawings which are given by way of illustration only, and thus are not limitative of the present invention and wherein:

FIG. 6 is a schematic chart for explaining the memory sections in a random access memory included in the electronic timepiece of FIG. 1;

DESCRIPTION OF THE PREFERRED EMBODIMENTS

Figure 1:
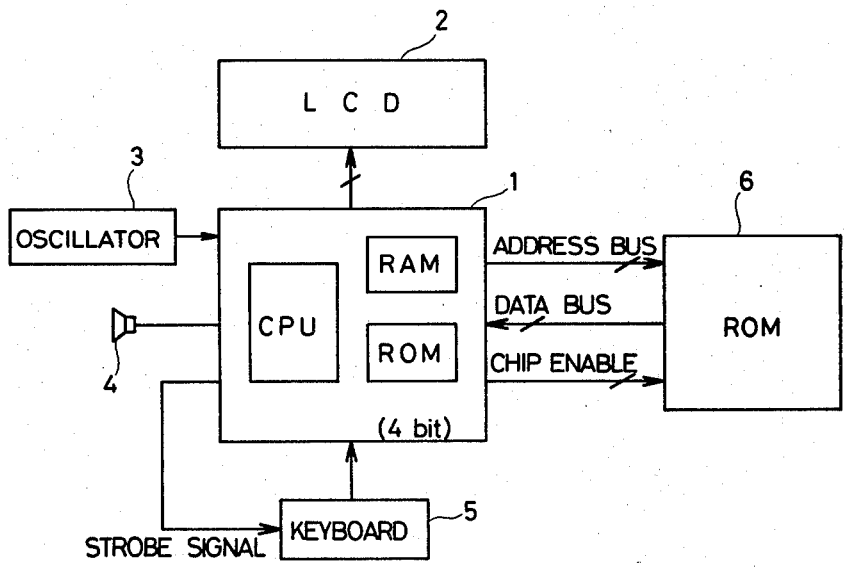
FIG. 1 is a schematic block diagram of an embodiment of an electronic timepiece of the present invention.

FIG. 1 shows an embodiment of an electronic timepiece of the present invention.

The electronic timepiece of the present invention comprises a one chip microcomputer 1 of the four bit construction, which includes a central processor unit, a random access memory and a read only memory. The one chip microcomputer 1 is connected to a digital display unit 2 implemented with a liquid crystal display panel, an oscillator circuit 3, an alarm sound generator 4, a key matrix array 5, and an outer read only memory 6. The outer read only memory 6 is disposed in the electronic timepiece and stores the sunrise time information and the sunset time information of each day in a year at each of a preselected plurality of cities in the world. The one chip microcomputer 1 performs the functions of (1) keeping the current information related to the timepiece operation and the calendar operation, (2) judging the key actuation, (3) changing the operation mode in response to the key actuation and setting the data in each operation mode, (4) reading in the data stored in the outer read only memory 6, (5) calculating the salat time, (6) detecting the coincidence between the calculated salat time and the current time data for controlling the generation of an alarm sound, and (7) controlling the display condition in each mode of operation.

Figure 2:
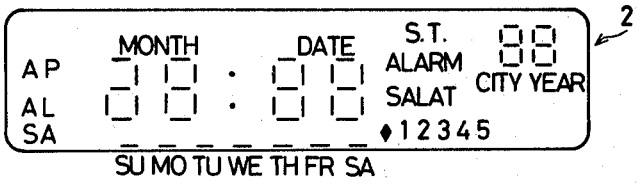
FIG. 2 is a plan view of a display panel included in the electronic timepiece of FIG. 1.
Figure 3:
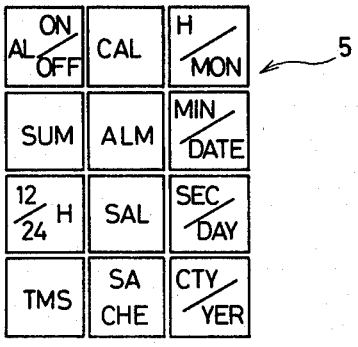
FIG. 3 is a plan view of a key matrix array included in the electronic timepiece of FIG. 1.

FIG. 2 shows the digital display unit 2, and FIG. 3 shows the key matrix array 5.

The key matrix array 5 includes twelve (12) pushbutton switches as shown in FIG. 3 for instructing the operation mode change, the display state change, the data setting operation and the data correction operation. In this embodiment there are four display modes, that is, (1) a normal display mode, (2) a calendar display mode, (3) an alarm display mode, and (4) a salat display mode. The salat display mode includes a first salat display mode SALAT 1, a second salat display mode SALAT 2, a third salat display mode SALAT 3, a fourth salat display mode SALAT 4 and a fifth salat display mode SALAT 5.

Figure 4:
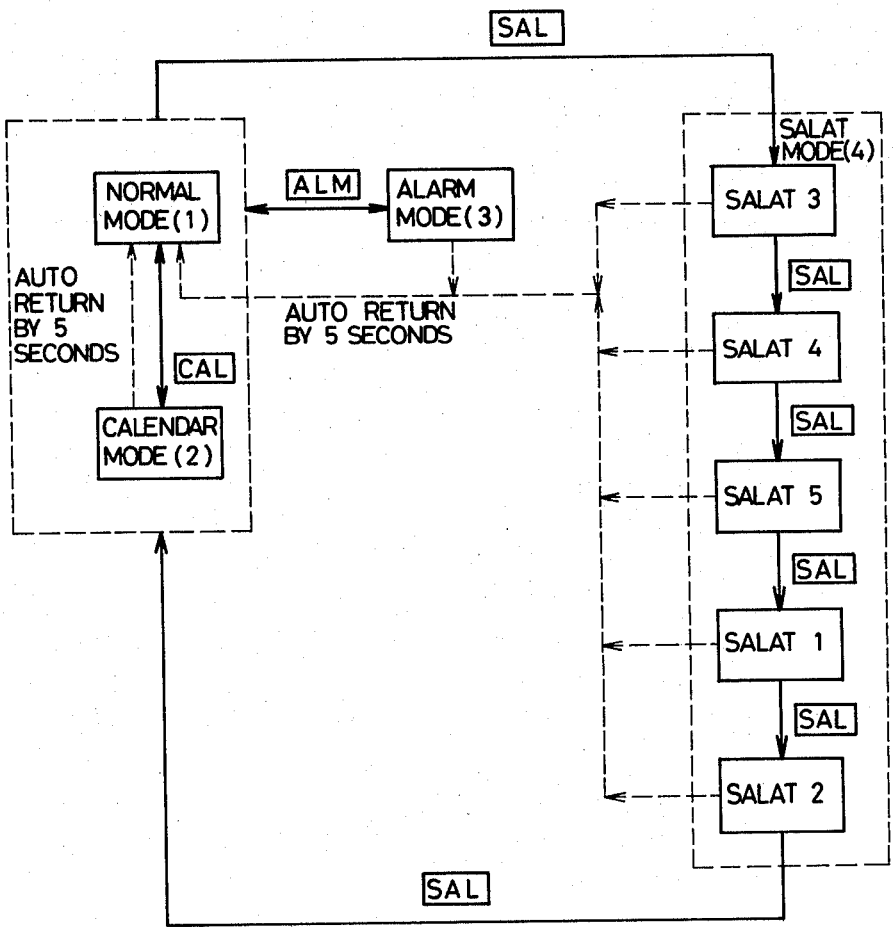
FIG. 4 is a flow chart for explaining a display selection operation performed by the electronic timepiece of FIG. 1.
Figure 5:
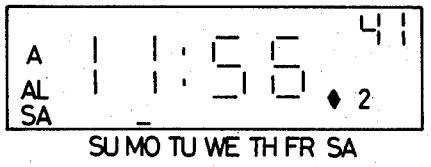
FIGS. 5(1), 5(2), 5(3) and 5(4) are plan views showing examples of the display pattern in various operation modes.
Figure 5:
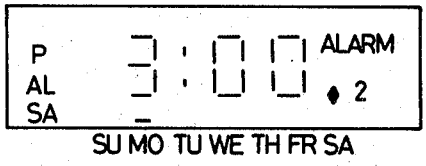
Figure 5:
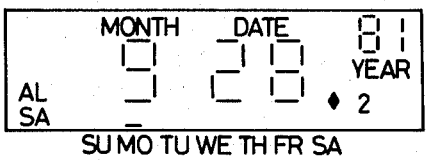
Figure 5:
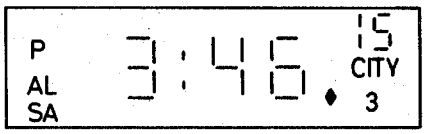

FIG. 4 is a flow chart for explaining the display state changing operation responding to an actuation of a preselected pushbutton switch. FIGS. 5(1) through 5(4) show examples of the display conditions in each display mode.

(1) NORMAL DISPLAY MODE

In the normal display mode, the electronic timepiece of the present invention displays the current time data regarding "hour", "minute" and "second". A symbol "A" or "P" is displayed to indicate before noon or after midday, respectively. A colon mark (:) is displayed between the hour data and the minute data. The day information is displayed by energizing one of seven day segmants SU, MO, TU, WE, TH, FR and SA. The day marks SU, MO, TU, WE, TH, FR and SA are printed on the display panel, and one of seven segments disposed in connection with the day marks is energized to selectively indicate the day information. In the normal display mode, a salat number (one of five numeral segments 1 through 5 is selectively energized), a salat check mark (♦), a daily alarm set mark (AL) and a salat set mark (SA) are selectively displayed. FIG. 5(1) shows an example of a display pattern in the normal display mode. The current time is eleven fifty-six and forty-one second, a.m., Monday. The daily alarm and the salat alarm are set. (The daily alarm set mark (AL) and the salat set mark (SA) are energized.) The displayed salat number is two (2), and the salat check mark (♦) is energized and, therefore, it is a time after the second salat time but before the salat check is conducted.

(2) CALENDAR DISPLAY MODE

When a calendar key [CAL] is actuated in the normal display mode, the electronic timepiece is placed in the calendar mode, wherein the current date data regarding "year" (lower two digits of A.D.), "month", "date" and "day" is displayed. A year mark (YEAR), a month mark (MONTH) and a date mark (DATE) are located at desired positions, and they are energized in the calendar mode to indicate the respective data. In the calendar mode, the salat number (one of five segments 1 through 5 is selectively energized), the salat check mark (♦), the daily alarm set mark (AL) and the salat alarm set mark (SA) are also selectively displayed. FIG. 5(2) shows an example of a display pattern in the calendar mode. The displayed date is Sept. 28, 1981, Monday. The daily alarm and the salat alarm are set. (The daily alarm set mark (AL) and the salat alarm set mark (SA) are energized.) The salat number two (2) and the salat check mark (♦) are energized as in the case of FIG. 5(1). The calendar display mode is automatically returned to the normal display mode, as shown in the flow chart of FIG. 4, when five seconds have passed in the calendar mode. Or when the calendar key [CAL] is again actuated in the calendar display mode, the electronic timepiece is returned to the normal display mode.

(3) ALARM DISPLAY MODE

When an alarm mode key [ALM] is actuated in the normal display mode or in the calendar display mode, the electronic timepiece is placed in the alarm display mode. When five seconds have passed in the alarm display mode, the electronic timepiece is automatically returned to the normal display mode. When the alarm mode key [ALM] is actuated in the alarm display mode, the electronic timepiece is forced to return to the normal display mode or the calendar display mode. In case where the electronic timepiece is forced to return to the calendar display mode, the electronic timepiece is automatically returned to the normal display mode when five seconds have passed in the calendar display mode.

In the alarm display mode, a daily alarm time regarding "hour" and "minute", the before noon symbol "A" or the after midday symbol "P", an alarm display mode indication mark (ALARM), the colon (:) mark between the hour data and the minute data, the day information, the salat number (one of five numbers 1 through 5), the salat check mark (⧫), the daily alarm set mark (AL) and the salat alarm set mark (SA) are displayed. The day information display, the salat number display (1 through 5) and the salat check mark (⧫) display are conducted in a same way as in the case of the normal display mode or the calendar display mode. FIG. 5(3) shows an example of a display pattern in the alarm display mode. The daily alarm is set at 3:00 p.m. The display indicates that today is Monday, the daily alarm and the salat alarm are set (the daily alarm set mark (AL) and the salat alarm set mark (SA) are enabled), the salat number is two (2), and the salat check has not been conducted (salat check mark (⧫) is enabled).

(4) SALAT DISPLAY MODE

In the salat mode, the salat number (1 through 5), the salat alarm time ("hour" and "minute") corresponding to the respective salat number, the before noon symbol (A) or the after midday symbol (P), a salat mode indication mark (SALAT), the colon mark (:) between the hour data and the minute data, the salat check mark (⧫), the daily alarm set mark (AL), the salat alarm set mark (SA) a city number and a city indication mark (CITY) are displayed.

When a salat mode key [SAL] is actuated in the normal display mode or in the calendar display mode, the electronic timepiece is placed in the salat display mode. The salat number first displayed is the next salat number. In an example shown in FIG. 4, the salat number two (2) is displayed in the normal display mode or in the calendar display mode and, therefore, the next salat number three (3) is first displayed when the salat mode key [SAL] is actuated. When the salat mode key [SAL] is actuated within five seconds, the salat number display is advanced. When the salat mode key [SAL] is actuated five times in the salat display mode, the electronic timepiece is forced to return to the normal display mode or the calendar display mode. If five seconds have passed in the salat display mode, the electronic timepiece is automatically returned to the normal display mode.

FIG. 5(4) shows an example of a display pattern in the salat display mode. The display indicates that the city number is fifteen (15), and the salat time of the third salat is 3:46 p.m. at that city. The salat check mark (⧫) corresponds to the salat check condition of the salat displayed in the normal display mode or in the calendar display mode. FIG. 5(4) shows that the salat check for the second salat has not yet been conducted. The daily alarm set mark (AL) and the salat alarm set mark (SA) are enabled to indicate that the daily alarm and the salat alarm are set, respectively.

Figure 7:
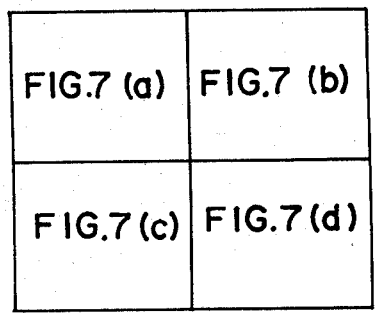
FIG. 7 is a flow chart for explaining the control operation associated with the random access memory of FIG. 6.
Figure 7:
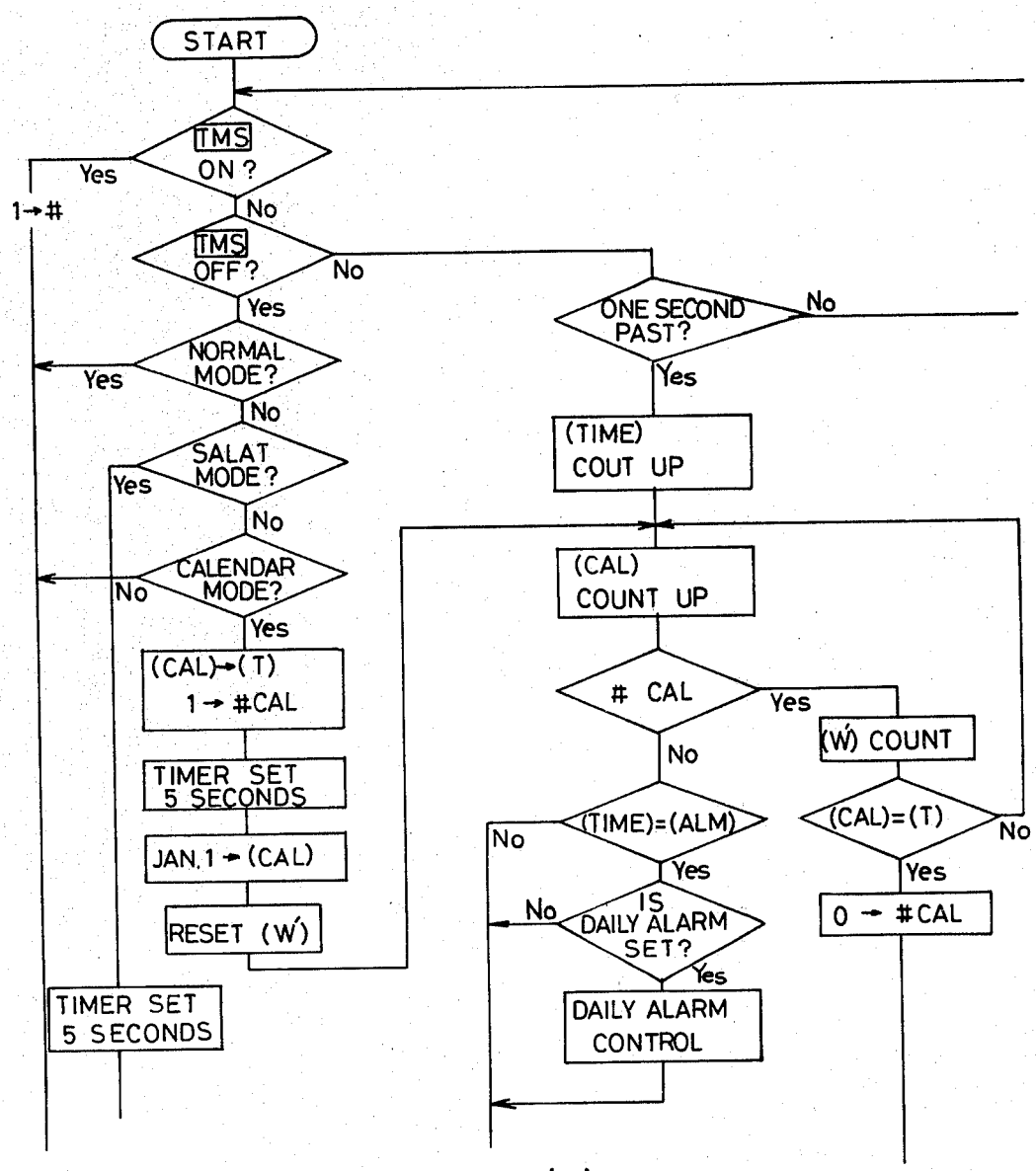
Figure 7:
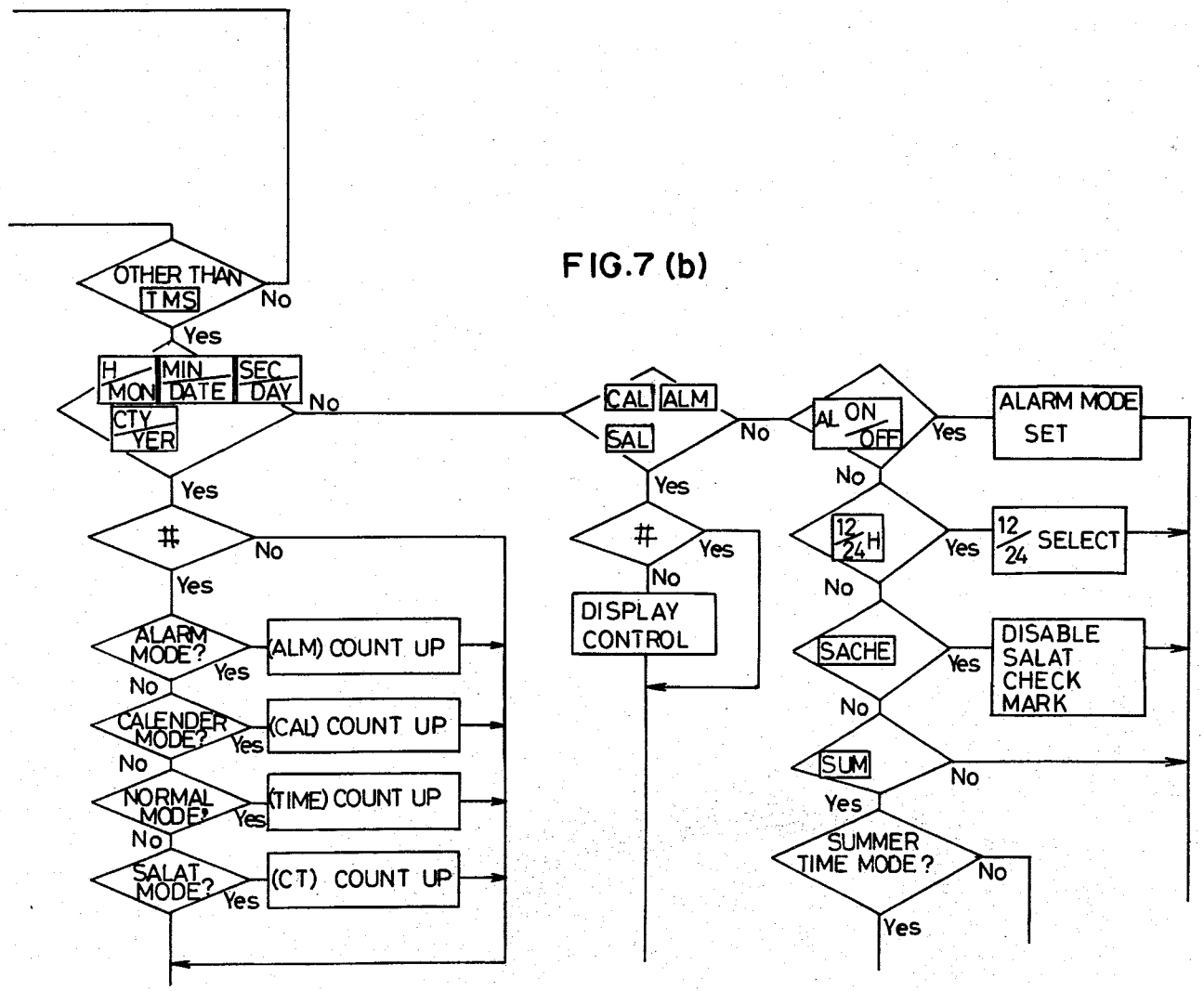
Figure 7:
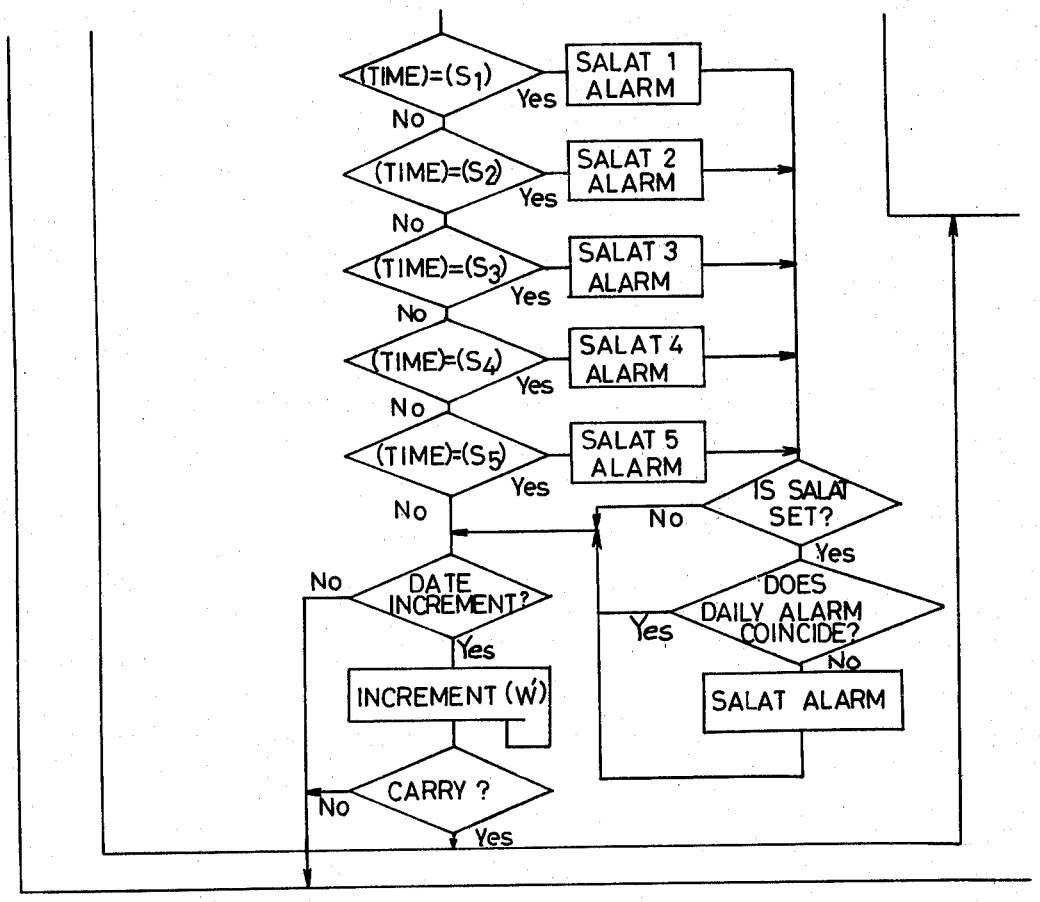
Figure 7:
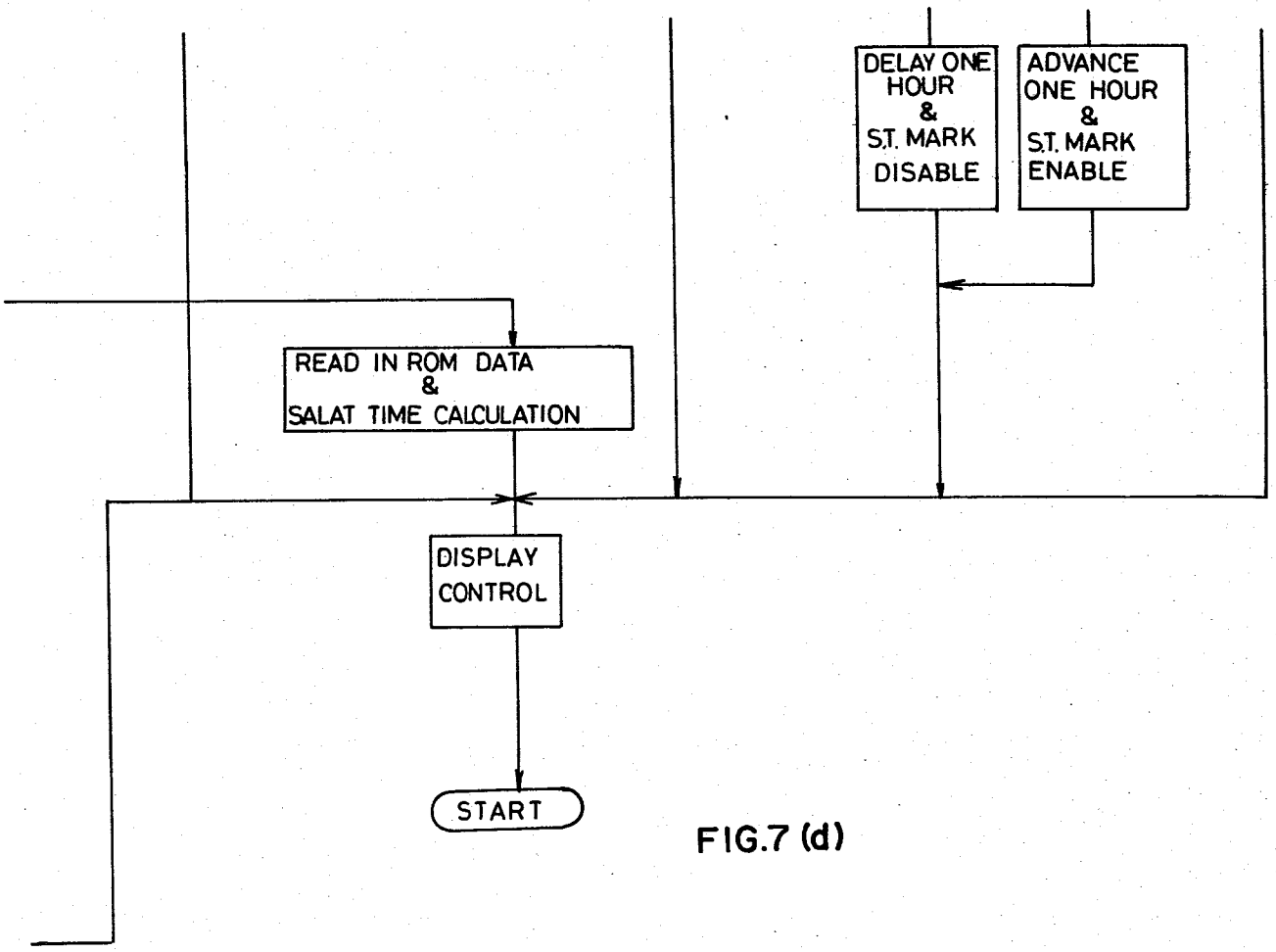

FIG. 6 shows a memory section map of the random access memory included in the one chip microcomputer 1. FIG. 7 shows a control flow for controlling the operation of each of registers included in the random access memory of FIG. 6.

0 through 5 rows in X column are display registers (DSP), 0 through 5 rows in Y column are time information registers (TIME) for storing the current time data regarding "hour", "minute" and "second" for performing the normal display mode, 0 through 5 rows in Z column are calendar registers (CAL) for storing the calendar data regarding "year", "month" and "date" for performing the calendar display mode, 2 through 5 rows in U column are alarm registers (ALM) for storing the preset alarm time regarding "hour" and "minute", 6 through 9 rows in Y column are first salat memory registers ($S_1$) for storing the first salat time regarding "hour" and "minute", 6 through 9 rows in Z column are second salat time memory registers ($S_2$) for storing the second salat time, 6 through 9 rows in M column are third salat time memory registers ($S_3$) for storing the third salat time, 6 through 9 rows in T column are fourth salat time memory registers ($S_4$) for storing the fourth salat time, and 6 through 9 rows in U column are fifth salat time memory registers ($S_5$) for storing the fifth salat time data. 1 and 2 rows in M column are date registers (W) for accessing the outer read only memory 6, 5 row in M column is an auxiliary register (W') for counting up the date register (W), and 3 and 4 rows in M column are city number registers (CT) for storing the city number and for accessing the outer read only memory 6. 0 through 5 rows in T column are correction auxiliary registers (T) for correcting the calendar data in the calendar display mode, and A and B rows in Y column are data correction setting flags (#) and calendar data correction setting flags (#CAL).

As shown in the flow chart of FIG. 7, the current time keeping operation is conducted to increment one count every one second except when a time set key [TMS] is actuated or when the time set key [TMS] is released or except when other keys are depressed. In this way, the contents stored in the time information registers (TIME) are incremented by one when one second has passed in order to keep the current time information for the normal display mode. When a carry is obtained after 24 hours have passed, the contents stored in the calendar registers (CAL) are incremented by one.

An alarm time coincidence judging operation is conducted except when the electronic timepiece is placed in the calendar data correction mode. The alarm time data stored in the alarm registers (ALM) are compared with the current time data stored in the time information registers (TIME). When the preset alarm time is identical with the current time, a daily alarm sound is generated only when the electronic timepiece is in the daily alarm set mode. The next of operation judges the coincidence between the current time data stored in the time information registers (TIME) and salat time data stored in the salat time memory registers ($S_1$) through ($S_5$). When one of the salat times memorized in the salat time memory registers ($S_1$) through ($S_5$) is identical to the current time data stored in the time information registers (TIME), the central processor unit functions to control flags to display the salat number and the salat check mark (⧫). Further, a salat alarm sound is generated when the salat alarm is in the set condition and the daily alarm sound is not generated.

Figure 8:
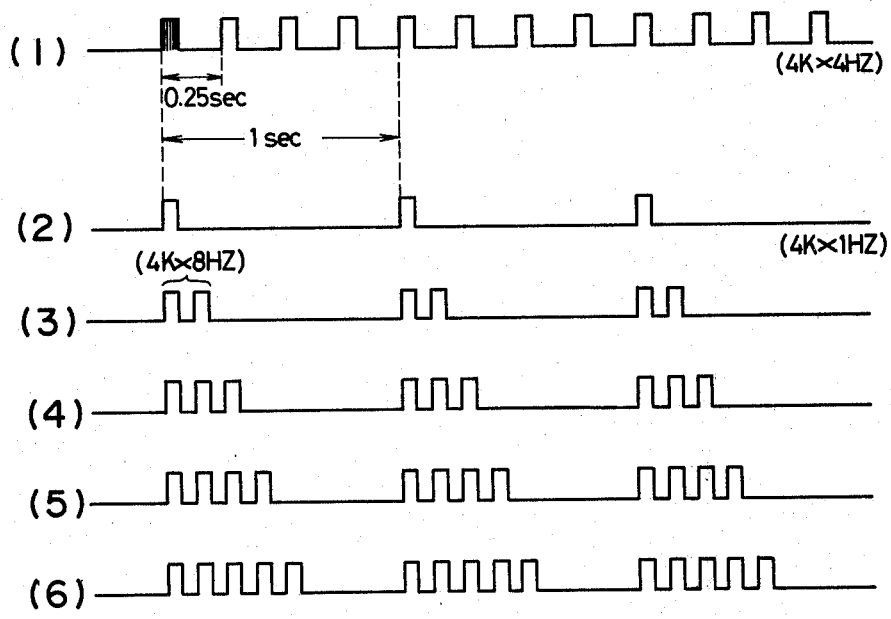
FIG. 8 is a time chart showing alarm sound waveforms of alarm sounds generated by the electronic timepiece of FIG. 1.

When any one of keys included in the key matrix array 5 is actuated when the alarm sound is being generated, the alarm sound generation is forced to terminate. At this moment, the specific operation assigned to the actuated key is not performed. The alarm sound generation is automatically terminated when twenty (20) seconds have passed. FIG. 8 shows the alarm sound waveforms. (1) represents the daily alarm sound, (2) represents the first salat alarm sound, (3) represents the second salat alarm sound, (4) represents the third salat alarm sound, (5) represents the fourth salat alarm sound, and (6) represents the fifth salat alarm sound. That is, the alarm sounds are different from each other to distinguish the respective alarms. In this embodiment, the priority is assigned to the daily alarm. Thus, when the daily alarm and the one of salat time are identical with each other, the daily alarm sound (1) is developed but the salat alarm sound is not developed. Under these conditions, the salat alarm is conducted by enabling or flickering the salat number display and the salat check mark (♦) display.

When the carry is developed from the time information registers (TIME), the contents stored in the calendar registers (CAL) are incremented by one. The contents stored in the date registers (W) are incremented by one only when the auxiliary register (W') develops the carry when the auxiliary register (W') counts up to seven (7). When the contents stored in the date registers (W) are changed, the data stored in the outer read only memory 6 is read out to update the data stored in the one chip microcomputer 1. More specifically, the one chip microcomputer 1 functions to calculate the five salat time through the use of the newly introduced data and to update the salat time stored in the salat time memory registers ($S_1$) through ($S_5$). That is, the salat alarm time data is updated once every seven (7) days passed. The above-mentioned operation is conducted when the key input operation is not conducted.

When the calendar key [CAL], the alarm mode key [ALM] or the salat mode key [SAL] is actuated, the display condition is changed to display the respective mode. The read in operation from the outer read only memory 6 and the salat time calculation operation are not conducted when these three keys are actuated.

When an actuation of an alarm on/off key [AL ON/OFF] is detected contents stored in an alarm set register (ALC) (a four bit binary register, and positioned at A row in Z column) are incremented. The alarm set register (ALC) determines the alarm sound generation when the current time reaches the preset daily alarm time or the calculated salat alarm time. More specifically, the alarm set register (ALC) bears one of the following four conditions. (1) Neither daily alarm sound nor salat alarm sound is generated. (2) Only the salat alarm sound is generated. (3) Both of the daily alarm sound and the salat alarm sound are generated. (4) Only the daily alarm sound is generated. As already discussed above, the contents stored in the alarm set register (ALC) are incremented by one upon every actuation of the alarm on/off set key [AL ON/OFF]. The alarm set condition is changed in the order of (1)→(2)→(3)→(4)→(1)→(2) - - - . The selected sound generation condition can be confirmed by observing the display conditions of the daily alarm set mark (AL) and the salat alarm set mark (SA).

When an actuation of a salat check key [SA CHE] is detected, the one chip microcomputer 1 functions to disable the salat check mark (♦). As already discussed above, the salat check mark (♦) is enabled when the current time reaches one of the five salat times. The thus enabled salat check mark (♦) is disabled when the salat check key [SA CHE] is actuated. The salat check mark ( ) is again enabled when the next salat time comes.

When an actuation of a summer time key [SUM] is detected, the electronic timepiece is placed in the summer time mode only if the electronic timepiece has not been in the summer time mode. A summer time mode indicator (S.T.) is enabled, and the hour data stored in the time information registers (TIME) and the salat memory registers ($S_1$) through ($S_5$) are advanced by one. However, the hour data stored in the alarm registers (ALM) is not changed. When the summer time key [SUM] is actuated under the condition where the electronic timepiece is in the summer time mode, the electronic timepiece is returned to the normal mode. That is, the summer time mode indicator (S.T.) is disabled, and the hour data stored in the time information registers (TIME) and the salat memory registers ($S_1$) through ($S_5$) are delayed by one. At this changing operation, it is not required to read in the data from the outer read only memory 6.

When an actuation of an hour change key [24/24 H] is detected, the hour information display is changed between the twelve hour base and the twenty-four hour base. The above-mentioned time information registers (TIME), the alarm registers (ALM) and the salat memory registers ($S_1$) through ($S_5$) store the hour information data in the twenty-four hour base. Thus, the hour information display to the twelve hour base is conducted at the display control section without influencing on the data stored in the respective registers.

The data correcting operation and the preset operation in respective operating modes will be described hereinbelow.

When the time set key [TMS] is actuated, a flag "#" is set to indicate that the data correcting operation is now conducted. Under the condition where the flag "#" is set, when an hour or month key [H/MON], a minute or date key [MIN/DATE], a second or day key [SEC/DAY] or a city or year key [CTY/YER] is actuated, the contents stored in the corresponding registers are incremented by one, respectively.

Now assume that the electronic timepiece is in the normal display mode. In the normal display correcting mode, the hour or month key [H/MON], the minute or date key [MIN/DATE] and the second or day key [SEC/DAY] are effective. When an actuation of the hour or month key H/MON is detected under the condition where the time set key [TMS] is being depressed, the hour information data stored in the time information registers (TIME) is incremented by one upon every actuation of the hour or month key [H/MON]. When the above-mentioned correcting operation is conducted, the carry derived from the tenth second register and the carry developed toward the calendar registers (CAL) and the auxiliary register (W') are ignored. When an actuation of the minute or date key [MIN/DATE] is detected under the condition where the time set key [TMS] is being depressed, the minute data stored in the time information registers (TIME) is incremented by one upon every actuation of the minute or date key [MIN/DATE].

When an actuation of the second or day key [SEC/DAY] is detected under the condition where the time set key [TMS] is being depressed, the zero adjustment operation is conducted. More specifically, if the second information stored in the time information registers (TIME) is greater than or equal to twenty-four (24) seconds when the second or day key [SEC/DAY] is actuated, the second data is forced to beome "00" and the minute data is incremented by one. If the second information stored in the time information registers (TIME) is less than twenty-four (24) seconds, the second data is forced to become "00" and the minute data is not changed. When the depression of the time set key TMS is released, the data correction mode is released and the electronic timepiece is returned to the normal display mode. When such a data correction operation is conducted, the salat number display and the salat check mark display are disabled. The salat number display and the salat check mark display are again enabled when the current time reaches the next salat time.

Now assume that the data correcting operation is conducted under the condition where the electronic timepiece is in the calendar display mode. In the calendar data correcting mode, the hour or month key H/MON, the minute or date key MIN/DATE, the second or day key SEC/DAY and the city or year key CTY/YER are effective when the time set key TMS is depressed. More specifically, when the time set key TMS is depressed in the calendar display mode, a calendar data correcting flag "#CAL" is set. The month information is incremented by one upon every actuation of the hour or month key H/MON, the date information stored in the calendar registers (CAL) is incremented when the minute or date key MIN/DATE is actuated, the day data and the year data are incremented when the second or day key SEC/DAY and the city or year key CTY/YER are actuated, respectively. The day information is stored at 0 row in U column (CALW) in the random access memory included in the one chip microcomputer 1.

After setting of the desired data, when the depression of the time set key TMS is released, the newly introduced data stored in the calendar registers (CAL) is transferred to the correction auxiliary registers (T). Thereafter, the data in the calendar registers (CAL) is forced to become "January 1", and the contents stored in the auxiliary register (W') and the date register (W) are cleared to zero. Then, the auxiliary register (W') and the calendar registers (CAL) are controlled to count up one by one till the contents stored in the calendar registers (CAL) become identical with the contents temporarily stored in the correction auxiliary registers (T). The contents stored in the date register (W) are incremented by one upon every development of the carry from the auxiliary register (W'). This preset operation is required to calculate the salat time. That is, it is required to know the date number counted from January 1. The contents stored in the date register (W) are used to access the data stored in the outer read only memory 6.

In the alarm data correction mode, the hour or month key H/MON and the minute or date key MIN/DATE are effective to count up the hour data and the minute data stored in the daily alarm registers (ALM). When the hour or month key H/MON is actuated under the condition where the time set key TMS is being depressed, the hour data in the daily alarm registers (ALM) is incremented. When the minute or date key MIN/DATE is actuated under the condition where the time set key TMS is being depressed, the minute data stored in the daily alarm registers (ALM) is incremented.

In the salat data correction mode, only the city or year key CTY/YER becomes effective to count up the contents stored in the city number registers (CT). More specifically, when the city or year key CTY/YER is actuated under the condition where the time set key TMS is being depressed in the salat display mode, the city number stored in the city number registers (CT) is incremented. When a desired city number is obtained by properly actuating the city or year key CTY/YER, the actuation of the time set key TMS is released to complete the city selection operation. While the city selection operation is conducted, the entire display is disabled except for the city information mark (CITY) and the city number display.

At a time when the actuation of the time set key TMS is released, the city number registers (CT) operate as the access register for reading out the data stored in the outer read only memory 6. The newly introduced data is used to calculate the salat time. After completion of these operation, the digital display unit 2 displays the first salat time at the selected city. The first salat time display is conducted for five seconds and the electronic timepiece is automatically returned to the normal display mode. When the system is returned to the normal display mode, the salat check mark display and the salat number display disappear. When the current time reaches one of the salat times after completion of the city selection operation, the salat number display and the salat check mark display are enabled. Under these conditions when the salat mode key SAL is actuated, the salat alarm time at the selected city is progressively displayed.

Figure 9:
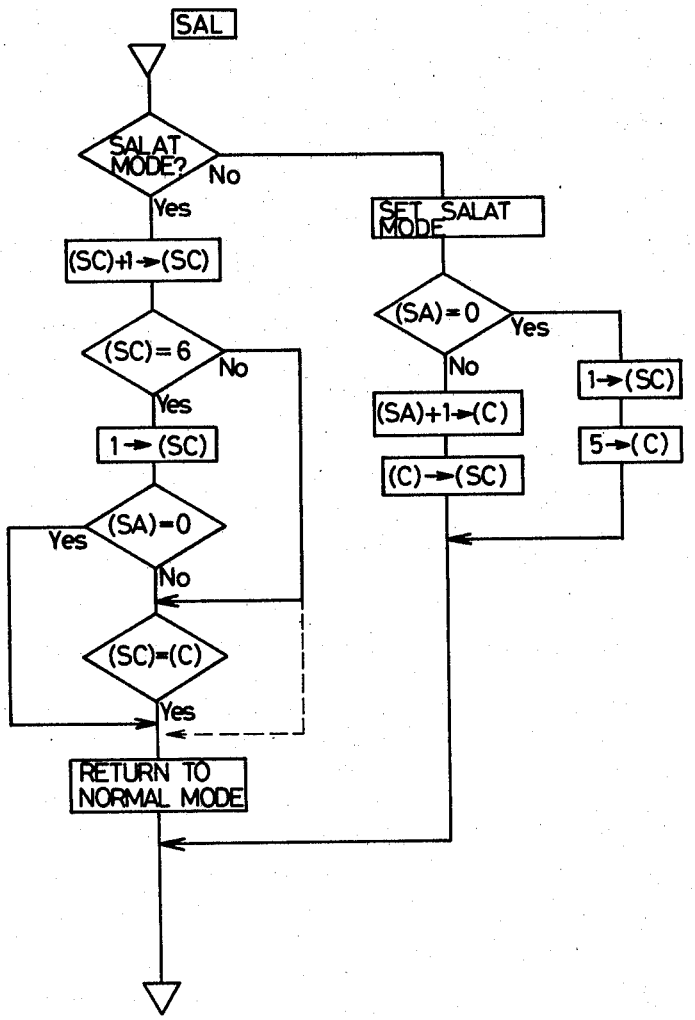
FIG. 9 is a flow chart for explaining operation modes of the electronic timepiece of FIG. 1 in connection with a salat key.

FIG. 9 shows the operation performed by the one chip microcomputer 1 when the salat mode key SAL is actuated.

When the salat mode key SAL is actuated under the condition where the electronic timepiece is in the normal display mode, the electronic timepiece is placed in the salat display mode. When the time data is corrected in the normal mode, or when the date data is corrected in the calendar mode, or when the city data is corrected in the salat mode, contents stored in a salat number memory (SA) (which stores the salat number to be displayed in the normal display mode, and located at C row in X column of the random access memory included in the one chip microcomputer) are reset. The reset state of the salat number memory (SA) is maintained until the current time reaches one of the salat times. Therefore, (SA)=0 represents the condition where the current time has not yet reached any salat times after the correction operation.

If (SA)≠0, the one chip microcomputer 1 conducts the calculation of (SA)+1 and the calculation results are introduced into a next salat number memory (C) (located at C row in Y column in the random access memory included in the one chip microcomputer 1). A salat mode memory (SC) (C row in Z column) stores the salat number which should be displayed in the salat display mode. The contents stored in the salat mode memory (SC) are incremented by the actuation of the salat mode key SAL. The initial data in the salat mode memory (SC) is identical with the data stored in the next salat number memory (C). Therefore, when the salat mode key SAL is actuated under the condition where the electronic timepiece is placed in the normal display mode, the next salat number and the salat time are displayed.

In case where (SA)=0, a data "1" is introduced into and stored in the salat mode memory (SC) and a data "5" is introduced into and stored in the next salat number memory (C) for ensuring the returning to the normal display mode. That is, the first salat is displayed if the current time has not yet reached any salat time after the data correction operation.

The followings are operations when the salat mode key [SAL] is actuated more than one time. That is, if the electronic timepiece is in the salat display mode when the salat mode key [SAL] is actuated, the contents stored in the salat mode memory (SC) is incremented in order to display the next salat number and the salat time. If the contents in the salat mode memory (SC) become "6", the data is forced to become "1" to display the first salat number and the salat time. That is, when the salat mode key [SAL] is actuated under the condition where the fifth salat is displayed, the display is changed to display the first salat data. When the salat data confirming operation is conducted after the correction operation, the electronic timepiece is returned to the normal display mode in response to the actuation of the salat mode key [SAL] under the condition where the fifth salat data is displayed. More specifically, the contents stored in the salat mode memory (SC) are incremented in response to the actuation of the salat mode key [SAL]. On the other hand, the next salat number memory (C) stores the salat number set by the first actuation of the salat mode key [SAL]. The system is returned to the normal display mode when the contents stored in the salat mode memory (SC) become identical with the contents stored in the next salat number memory (C).

The data access operation related to the outer read only memory 6, and the salat time calculation operation will be described hereinbelow.

The data read in operation from the outer read only memory 6, and the calculation of the updated salat time are conducted when one of the following conditions occurs. (1) The contents stored in the date register (W) are incremented. (The data in the date register (W) is changed at every seven days.) (2) The data correction operation is conducted in the calendar display mode. And (3) the city number correction operation is conducted in the salat display mode.

Figure 10:
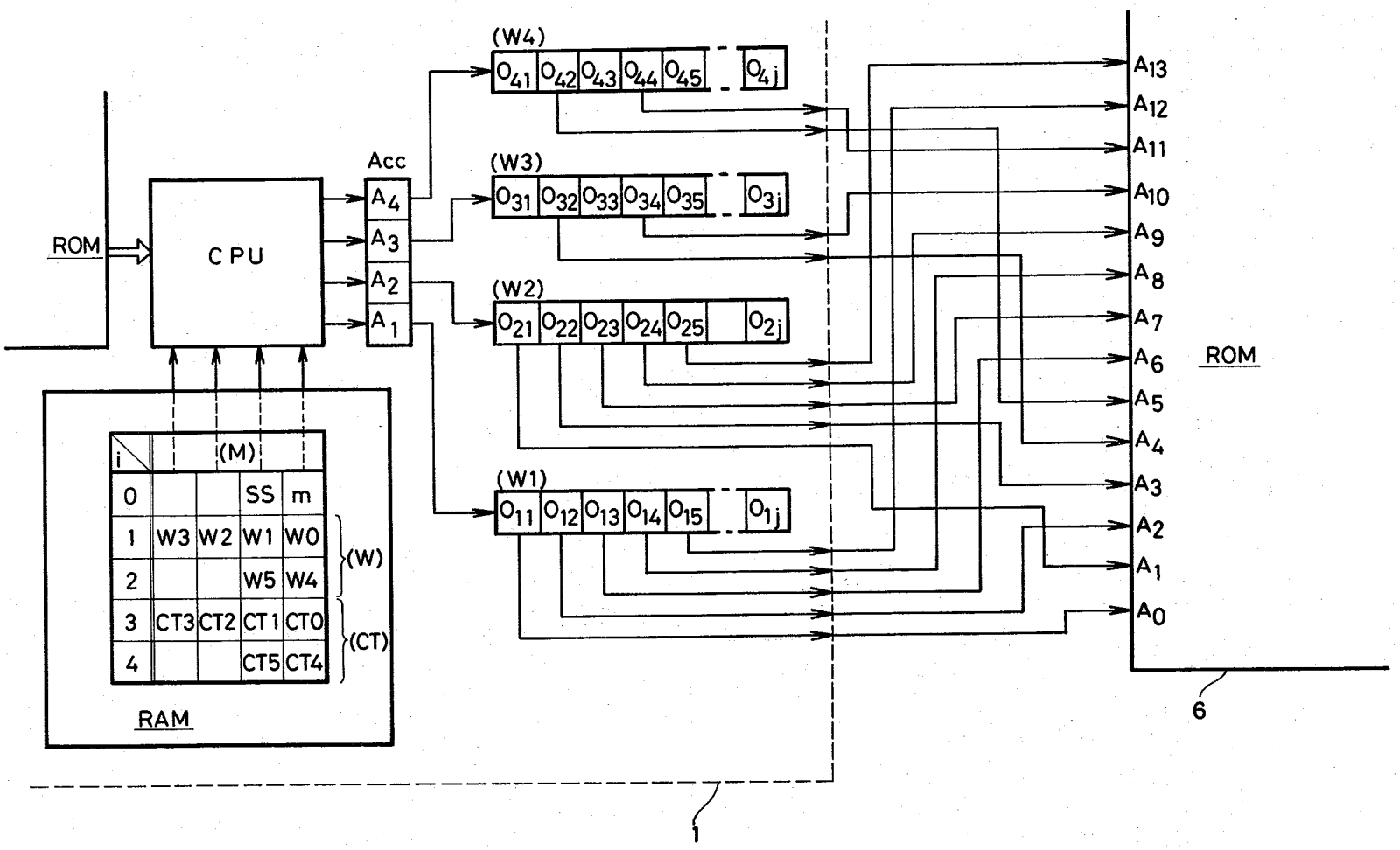
FIG. 10 is a detailed block diagram of an essential part of the electronic timepiece of FIG. 1.

FIG. 10 is a detailed block diagram of an essential part of the one chip microcomputer 1.

As already discussed above, the contents stored in the date registers (W) included in the random access memory in the one chip microcomputer 1 are incremented upon every seven days in the normal operation mode. The date registers (W) are six bit ($W_0$ through $W_5$) binary construction. The city number registers (CT) are six bit ($CT_0$ through $CT_5$) binary construction, and function to store the city number data. The binary city number data is decoded into the decimal number for displaying the city number on the digital display unit 2. A flag SS (0 row in M column) controls the sunrise data access operation, and a flag m (0 row in M column) controls the minute data access operation.

The access data stored in the M column of the random access memory is transferred to shift registers $W_1$–$W_4$ through accumulators $A_1$–$A_4$ in a four bit parallel fashion. An output signal $O_{ij}$ (i=1 through 4) of the shift registers $W_1$–$W_4$ is used to access the outer read only memory 6.

Figure 11:
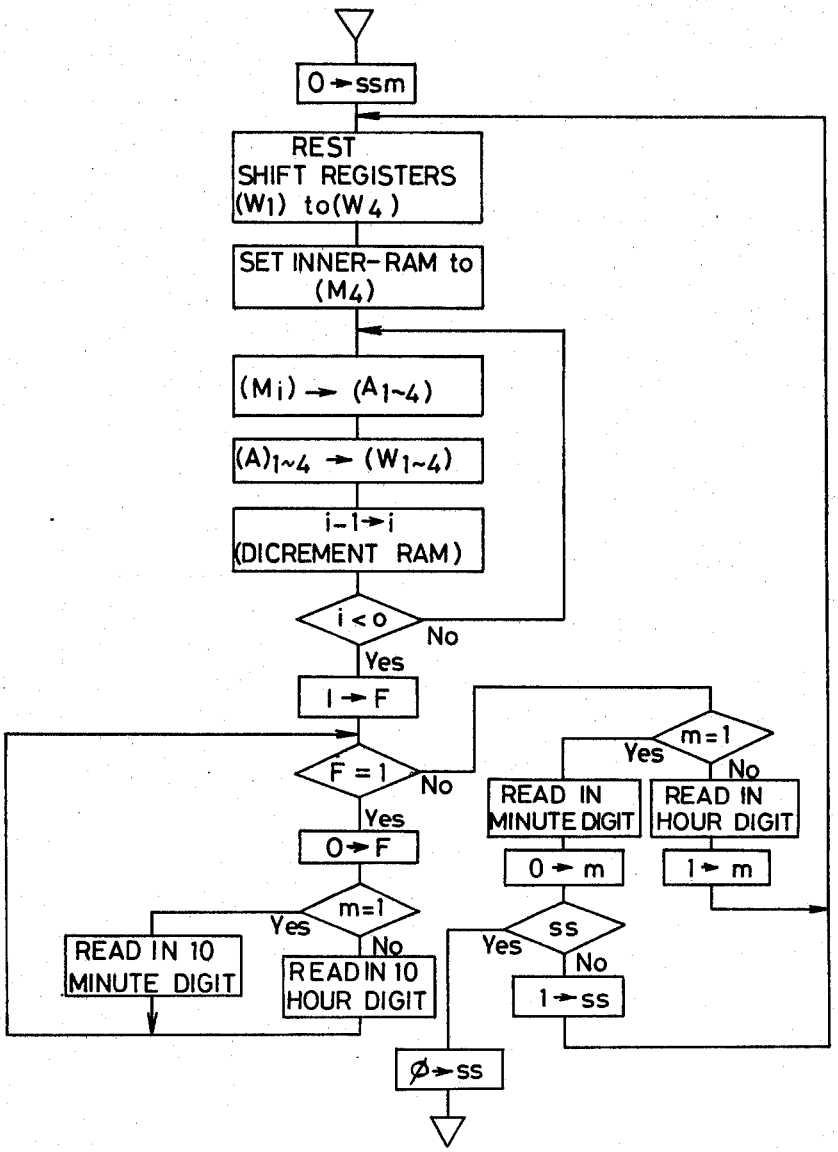
FIG. 11 is a flow chart for explaining the operation of the electronic timepiece shown in FIG. 10.

FIG. 11 is a flow chart for explaining the access operation. First, the flags SS and m, and the shift registers $W_1$–$W_4$ are reset. Then, the data (O, O, $CT_5$, $CY_4$) which is positioned at the fourth row in the M column is transferred to the accumulators $A_1$–$A_4$. Thereafter, the data (O, O, $CT_5$, $CT_4$) is introduced into the shift registers $W_1$–$W_4$. More specifically, the data "0" is introduced into the first bit $O_{41}$ of the shift register ($W_4$), the data "0" is introduced into the first bit $O_{31}$ of the shift register ($W_3$), the data "$CT_5$" is introduced into the first bit $O_{21}$ of the shift register ($W_2$), and the data "$CT_4$" is introduced into the first bit $O_{11}$ of the shift register ($W_1$), respectively.

Figures 12, 13:
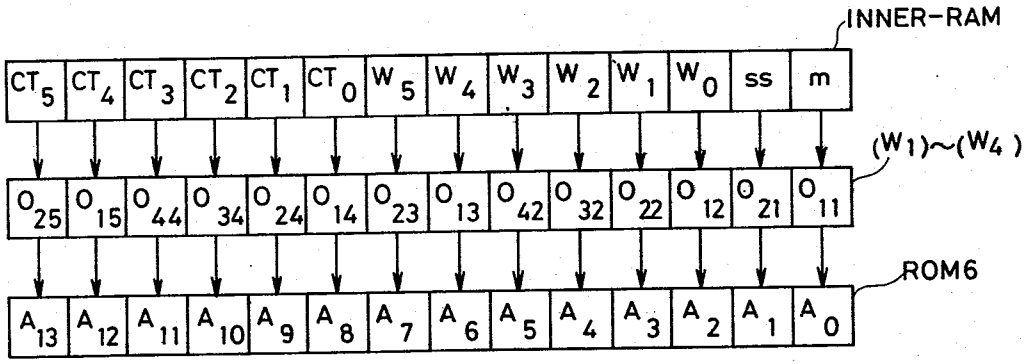
FIG. 12 is a chart for explaining relationships between the random access memory and an outer read only memory included in the electronic timepiece of FIG. 1.
FIG. 13 is a chart showing an example of the data storage in the outer read only memory shown in FIG. 12.

Next, the row addresss of the random access memory is decremented for transferring the data ($CT_3$, $CT_2$, $CT_1$, $CT_0$) to the shift registers $W_1$–$W_4$ via the associated accumulator $A_1$–$A_4$. That is, the data (O, O, $CT_5$, $CT_4$) is shifted to the second bit $O_{42}$, $O_{32}$, $O_{22}$, $O_{12}$ and the data ($CT_3$, $CT_2$, $CT_1$, $CT_0$) is introduced into the first bit $O_{41}$, $O_{31}$, $O_{21}$, $O_{11}$. The address data is transferred to the shift registers $W_1$–$W_4$ in this way. FIG. 12 shows the final condition when the data transfer from the random access memory to the shift registers $W_1$–$W_4$ is completed. The output signal $O_{ij}$ of the shift registers $W_1$–$W_4$ is applied to the address input terminals ($A_{13}$ through $A_0$) of the outer read only memory 6.

FIG. 13 shows an example of the data ($D_0$ through $D_7$) stored in the outer read only memory 6 corresponding to the respective address ($A_{13}$ through $A_0$). As already discussed above, the one chip microcomputer 1 operates in a four bit base. Therefore, the read in operation from the outer read only memory 6 must be conducted in the four bit base. A flag "F" at C row in M column of the random access memory functions to control the read in operation. More specifically, when the flag "F" is in the set state, the upper four bit data ($D_4$ through $D_7$) is read out from the outer read only memory 6. When the flag "F" is in the reset state, the lower four bit data ($D_0$ through $D_3$) is read out from the outer read only memory 6.

First, the flag "F" is set to enable the reading out the tenth hour data (10 HS) of the sunrise time. The thus read out data is introduced into the tenth hour section (9 row in Z column) of the second salat time memory registers ($S_2$). Then, the flag "F" is reset for reading out the hour data (1 HS) of the sunrise time. The thus read out data is introduced into the hour section (8 row in Z column) of the second salat time memory registers ($S_2$). Thereafter, the minute flag "m" is set, and the shift registers ($W_1$) through ($W_4$) are reset to perform the read operation of the minute data. The minute data of the sunrise time is introduced into and stored in the tenth minute section and the minute section (7 and 6 rows in Z column, respectively) of the second salat time memory registers ($S_2$). After completion of the read in operation of the sunrise time data, the flag "SS" is set in order to read in the sunset time data. The read out sunset data is introduced into and stored in the fourth salat time memory registers ($S_4$). That is, the outer read only memory 6 stores the sunrise time data and the sunset time data at each time and each city number.

After completion of the read in operation of the sunrise time data into the second salat time memory registers ($S_2$) and the sunset time data into the fourth salat time memory registers ($S_4$), the salat time calculation operation is conducted. As already discussed above, the fourth salat time is the sunset time. Thus, the data introduced into the fourth salat time memory registers ($S_4$) is not required to be changed. At the frist stage, the sunrise time data temporarily stored in the second salat time memory registers ($S_2$) is transferred to arithmetic calculation registers (ALU) (6 through 9 rows in X column of the random access memory included in the one chip microcomputer 1). Then, the calculation of (sunrise time)−(one hour) is conducted to obtain the first salat time (Fajr). The calculation results are introduced into and stored in the first salat time memory registers ($S_1$). The next calculation is $[(ALU)+(S_4)]/2$. The calculation results are introduced into and stored in the second salat time memory registers ($S_2$). ($S_2$)+(3 hours) data is introduced into and stored in the third salat time memory registers ($S_3$). ($S_4$)+(one hour and thirty minutes) data is introduced into and stored in the fifth salat time memory registers ($S_5$).

In this way, the first salat time memory registers ($S_1$) store the alarm time data for the first salat (Fajr).

The second salat time memory registers ($S_2$) store the alarm time data for the second salat (Zuhr). The third salat time memory registers ($S_3$) store the alarm time data for the third salat (Asr). The fourth salat time memory registers ($S_4$) store the alarm time data for the fourth salat (Magrib). The fifth salat time memory registers ($S_5$) store the salat alarm time for the fifth salat (Isha). The thus stored salat times are compared with the current time information. When the current time reaches one of the stored salat alarm times, the salat alarm sound is developed and the salat number (one of five numbers 1 through 5) and the salat check mark ( ⧫ ) are displayed.

In a preferred form, the one chip microcomputer 1 is a "LU-04115" manufactured by Sharp Corporation. The outer read only memory 6 is a "LH-539627" manufactured by Sharp Corporation. Further, a timepiece module "LX-32130" manufactured by Sharp Corporation includes the "LU-04115", "LH-539627", the oscillator 3, the liquid crystal display panel 2, the key matrix array 5 and the substrate for supporting these elements.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A salat time alarm electronic timepiece comprising:

current time keeping means for storing current time data and current calendar data;

main memory means for storing sunrise time and sunset time data associated with various cities in in the world;

city selection means for selecting a desired city from said various cities in the world;

date determining means for determining date data representative of the actual date;

read out control means for reading out said sunrise time and sunset time data stored in said main memory in response to output signals derived from said city selection means and said date determining means;

calculation means for calculating a plurality of salat times through the use of the data read out by said read out control means;

salat time storage means for storing the plurality of salat times obtained by said calculation means;

comparison means for comparing the plurality of salat times stored in said salat time storage means with said current time data stored in said current time keeping means and for developing a detection output when the current time reaches one of said plurality of salat times; and alarm means for providing an alarm display in response to said detection output developed from said comparison means.

2. The salat time alarm electronic timepiece of claim 1, wherein said alarm means includes an alarm sound generator, and a driver circuit for activating said alarm sound generator in response to said detection output developed from said comparison means.

3. The salat time alarm electronic timepiece of claim 2, wherein said driver circuit develops different activating signals for each of said plurality of salat times, thereby generating different alarm sounds for each of said plurality of salat times.

4. The electronic timepiece of claim 1, wherein said date determining means comprises:

first counter means connected to receive a date signal derived from said current time keeping means and for developing an output signal when seven days have passed; and second counter means for counting said output signal derived from said first counter means, the contents stored in said second counter means being used as said date data.

5. The salat time alarm electronic timepiece of claim 1, 2, 3 or 4, further comprising:

a digital display panel for displaying at least said current time data and said alarm display associated with said alarm means; and a display drive system for providing a display on said digital display panel of present prayer data concerning at least one of said plurality of salat times.

6. The salat time alarm electronic timepiece of claim 5, wherein said digital display panel includes:

a first section for displaying a salat number from said plurality of salat times;

a second section for displaying the salat time data; and a third section for indicating whether the prayer corresponding to said salat number has already been conducted.

7. The salat time alarm electronic timepiece of claim 6, further comprising:

a key matrix array for introducing desired commands into said salat time alarm electronic timepiece, said key matrix array including a salat check key; and salat check driving means for disabling said third section when said salat check key is actuated.

8. The salat time alarm electronic timepiece of claim 1, 2, 3 or 4, further comprising:

a summer time key for entering a summer time mode; and summer time mode control means responsive to said summer time key for increasing the hour data stored in said current time keeping means and said salat time storage means by one hour.

9. The salat time alarm electronic timepiece of claim 1, 2, 3 or 4, further comprising:

daily alarm time storage means for storing a preset daily alarm time;

daily alarm time comparison means for developing a daily alarm detection output when the current time reaches said preset daily alarm time; and daily alarm means for providing a daily alarm display in response to said daily alarm detection output.

10. The salat time alarm electronic timepiece of claim 9, further comprising:

priority determination means for applying the priority to said daily alarm means when said preset daily alarm time is identical to one of said plurality of salat times.

* * * * *